United States Patent [19]

Alexander

[11] 4,355,914

[45] Oct. 26, 1982

[54] ACOUSTIC HOOD WITH GLARE SHIELD

[75] Inventor: James S. Alexander, Paris, Ky.

[73] Assignee: International Business Machines Corporation, Armonk, N.Y.

[21] Appl. No.: 145,546

[22] Filed: May 1, 1980

[51] Int. Cl.[3] ..... B41J 29/08

[52] U.S. Cl. ..... 400/690.1; 400/713

[58] Field of Search ..... 400/689, 690, 690.1, 400/690.2, 690.3, 690.4, 713, 714, 716; 181/201

[56] References Cited

U.S. PATENT DOCUMENTS

| | | | |
|---|---|---|---|
| 1,553,480 | 9/1925 | Stickney | 400/690.1 |
| 1,559,677 | 11/1925 | Corcoran | 400/689 |
| 1,866,582 | 7/1932 | Smith | 400/690.1 X |
| 3,513,938 | 5/1970 | Buehner et al. | 400/690.1 X |

FOREIGN PATENT DOCUMENTS

| | | | |
|---|---|---|---|
| 2457188 | 6/1976 | Fed. Rep. of Germany | 400/690.1 |

OTHER PUBLICATIONS

IBM Technical Disclosure Bulletin, "Positionable Acoustic Hood Incorporating a Positionable Visor", Alexander et al., vol. 20, No. 2, Jul. 1977, pp. 659–660.

*Primary Examiner*—Ernest T. Wright, Jr.
*Attorney, Agent, or Firm*—Laurence R. Letson

[57] ABSTRACT

The device disclosed is a combination sound hood and glare suppressing visor for use on office machines such as typewriters, to contain machine operating noise while at the same time retaining visibility of the document being printed.

The device is moveable away from the paper opening of the typewriter or office machine to allow access to the printing region of the typewriter and, upon the removal of the device from the printing region, the glare shield is lowered or collapsed controllably to remove obstructions to operator access of the printing zone. As the sound hood is replaced over the paper aperture of the typewriter or printer, the glare shield is again erected to its preset position to suppress glare from overhead and back lighting illumination. The visor is adjustable to present substantially an edge view thereof, thereby minimizing operator distraction. The sound hood may be pivotally raised to a vertical or past vertical position to give access to the printing element or the typing zone. As the hood is raised, the angle between the hood and visor becomes substantially zero, at which point the visor is raised along with the hood and positioned out of the way leaning backward away from the operator. As the hood is repositioned over the opening of the top of the typewriter to contain the acoustic vibrations, the visor is again positioned in its preset position.

21 Claims, 7 Drawing Figures

ACOUSTIC HOOD WITH GLARE SHIELD

BACKGROUND OF THE INVENTION

The sound hood disclosed herein is related to the field of office machines and, particularly, is advantageously adapted for and used on typewriters. In the past, many efforts have been made to suppress the sound of a typewriter and they mostly centered about the enclosing of the typewriter either in a separate shield or in its cover with a closure being of transparent material to contain the sound while at the same time permitting the viewing of the typing in progress. An example of a shield involving a transparent member is Stickney, U.S. Pat. No. 1,553,480, which is exemplary of the early efforts.

In order to overcome undesirable glare off the surface of the transparent material, efforts were made to position glare shields, such as that shown in Smith, U.S. Pat. No. 1,866,582.

Refinements include the design of sound hoods with surfaces positioned such that they will not reflect overhead or backlighting illumination. An example of that is Buehner, et al, U.S. Pat. No. 3,513,938, wherein the surfaces of the sound hood are positioned so that reflective light glare is eliminated with respect to the eye of the operator at a normal operating position.

Additionally, sound hoods have been formed as a cover for closing the opening in the typewriter proximate the print point and have been pivotally mounted together with a visor for eliminating lighting reflections and glare. The visors of the sound hoods have been both the adjustable type as well as those which are formed as a fixed portion of the sound hood and, thus, immoveable with respect to the portion which closes the opening proximate the print point of the typewriter.

In both cases, the visor does present an impediment to free access to the machine due to the fact that either it is displaced from the desired position during the opening of the sound hood or remains erected requiring that the sound hood be held in its lifted position for access. If the sound hood is moved forward to open the opening proximate the print point on the typewriter, the visor will remain erected and provide a partial barrier to easy access to the print zone.

OBJECTS OF THE INVENTION

It is an object of the invention to suppress sound resulting from the printing operation of a typewriter with a sound containment closure, portions of which will collapse upon removal from the opening proximate the printing zone to provide unobstructed access to the printing zone.

It is another object of the invention to reerect portions of the sound hood upon the closure of the opening in the typewriter near the print zone.

It is a further object of the invention to reposition the visor of a sound hood to a preselected position upon the positioning of the sound hood in its normal operating location.

The shortcomings of the prior art are overcome, together with the accomplishments of the objects of this invention by mounting on a typewriter, a pair of arms which will support a transparent panel member over the opening of the printing zone of the typewriter and accomplishing that mounting with a hinge pin or rod so that the panel member may be pulled to a position closer to the operator swinging the support arms about their pivot point. Mounted on the same pivot hinge pin is a glare visor in the form of a second panel member which may be positioned at infinite positions about its pivot axis.

Restricting the movement of the glare visor with respect to the first panel and the typewriter is a frictional member fitting into a bushing. The frictional member is provided with a positioning lug which will be trapped between the transparent panel member and the pivot support arms and, thus, restrict the frictional member from free rotation about the axis of the hinge pin. The frictional engagement between the frictional member and the bushing will act to support the bushing in a fixed rotational position about the friction member and, therefore, support the visor which is attached to the bushing.

This permits the closure of the aperture above the printing zone of a typewriter to contain and suppress noise emissions from the typewriter during operation and printing while, at the same time, allowing the operator to adjust the visor to an angle which minimizes the view of the visor to the operator and, at the same time, suppresses unwanted lighting glare from the closure panel.

Upon the opening of the aperture proximate to the print zone of the typewriter, the friction member is relieved and may rotate around the hinge pin, thus allowing the visor to collapse onto the transparent panel or alternatively the transparent panel forces the visor up and back if the transparent panel is pivoted to open the print zone aperture, whereby easier access to the print element and the print zone is accomplished.

As the transparent panel is repositioned over the print zone opening of the typewriter, the friction member is again engaged by either the pivot arm or the transparent panel and eventually the friction member is positioned by one or both of these members to confine it to a position dictated by the transparent panel and the visor and the pivot arm, thereby repositioning the visor to the operator selected position it previously occupied prior to opening.

DESCRIPTION OF THE INVENTION

Figure 1:
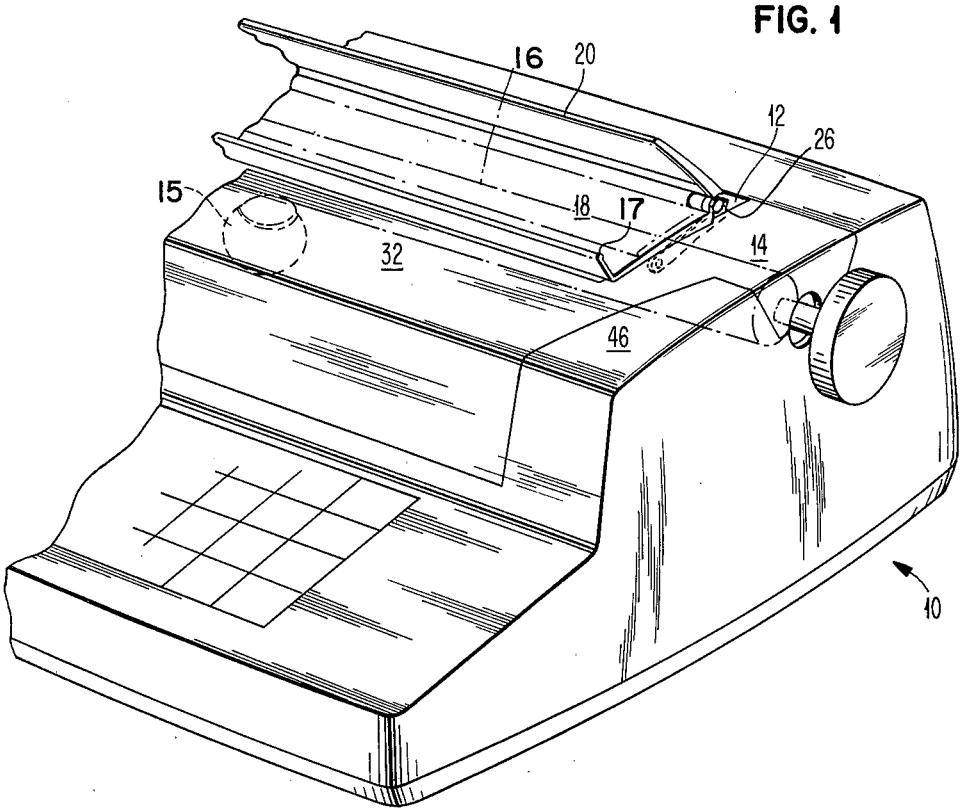
FIG. 1 illustrates a typewriter with the sound hood and glare visor in normal operating position.
Figure 2:
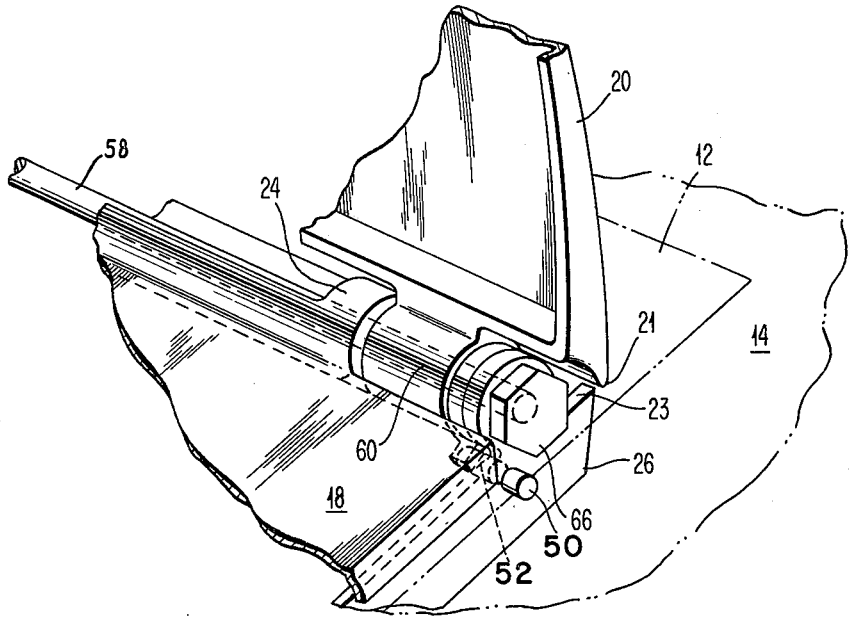
FIG. 2 illustrates the right end of the hinge assembly of the sound hood and visor, together with the pivot arms and friction member in an assembled condition.

Many typewriters 10 have openings 12 in the top surface 14 of the typewriter 10. This opening 12 permits access to the print zone along the print line as defined between a platen 16 and a print element 15 which may traverse along the surface of the platen 16. This opening 12 found in many office typewriters 10 is an easy exit port for the operating noises and sounds of the typewriter 10 as well as the impacting sound created by printing when the print element 15 or other print font carrying member impacts the platen such as 16.

The suppression of the operating sounds of the typewriter 10 being desirable, the most direct approach is to close the opening 12 in the top of the typewriter 10 by placing over that opening 12 a member 18 to prevent the easy exit of impact noise and vibrations. Illustrated in the drawing and particularly FIG. 1 is a sound hood 18 or panel member 18 having transparent properties for easily observing the print line of the typewriter. The positioning of a transparent member 18 in a relatively flat plane on the top surface 14 of a typewriter 10 has been found to require additional measures to suppress the glare of overhead office lighting. To suppress or block that glare from the surface of the sound hood 18, a glare visor 20 is positioned at an angle and extending from the back of the sound hood 18 upward and toward the operator's eye position.

To present a minimum view of the glare visor 20, it is desirable that the glare visor 20 be moveably mounted with respect to the sound hood 18. The glare visor 20 may thus be adjusted by the operator to provide a substantially narrow or edge view thereof, reducing distraction and increasing visibility of the typed material as it exits from the print zone of the typewriter 10 which is that region approximate to the print line.

In order to provide access to the print zone of the typewriter 10 for the accessing of the typewritten work, the changing of impression levels, the changing of type elements, the adjustment of the typing page and the correction of typing errors, it is necessary to open the opening or aperture 12 near the print zone by moving the sound hood 18 out of the way. This may be accomplished in two different fashions. The first is where the sound hood 18 is grasped and pivoted upward about its pivot or hinge shaft 58. This will raise the sound hood 18 giving a fairly complete access to the print zone. This pivoting is permitted by the loose fit of the hinge portion 24 of sound hood 18 about shaft 58.

Figure 3:
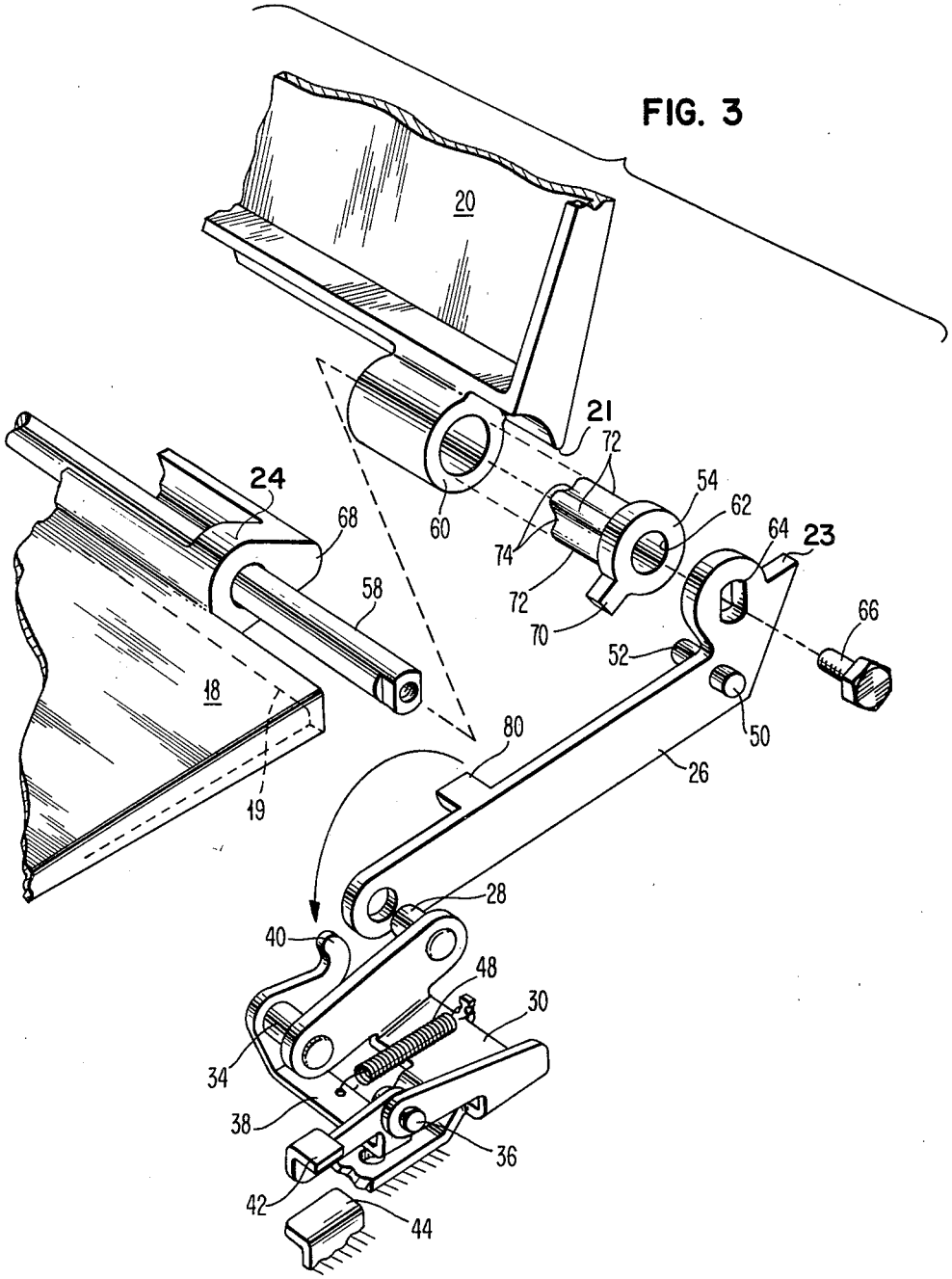
FIG. 3 illustrates the right end portion of the sound hood assembly in an exploded view, together with a retaining latch operated by the typewriter cover closure.
Figure 7:
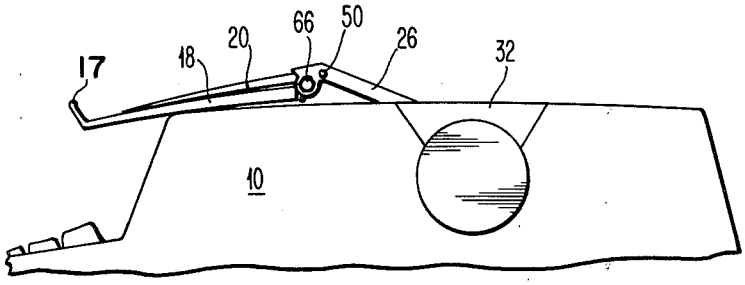
FIG. 7 illustrates the sound hood pulled forward toward the operator to open the print zone opening and, thus, collapse the visor onto the sound hood.

The second technique for opening the closed sound hood 18 is to grasp the sound hood 18 and pull forward toward the operator to a position as illustrated in FIG. 7. The movement of the sound hood 18 to the forward open position in FIG. 7 is permitted by pivot arms 26 illustrated in all figures, in varying positions and varying degrees of completeness. Referring to FIG. 3 for ease of understanding, where one end of the sound hood assembly and support structure is illustrated, understanding that the opposite end of the sound hood 18 is likewise supported with a similar pivot arm not shown, the pivot arm 26 is mounted on a pivot pin 28 which, in turn, is supported on a mounting bracket 30 which, in turn, is secured by conventional attaching techniques to the interior of the top cover 32 which forms a portion of the top surface 14 of typewriter 10. Mounting bracket 30, further by means of pins 34 and 36, supports a bellcrank 38 with a hook 40 formed in one end of the bellcrank 38 and an engaging tab 42 formed in the opposite end. Placed in engaging relationship to tab 42 is bracket 44 which is mounted on the typewriter cover, middle portion 46. Bellcrank 38 is spring biased by tension spring 48 between bracket 30 and bellcrank 38 as illustrated in FIG. 3.

To provide engaging and support surfaces on pivot arm 26, two short studs 50 and 52 are formed into opposite surfaces of the pivot arm 26. Stud 50 is of sufficient length to engage the top cover 32 of the typewriter 10 while stud 52 will engage friction member 54.

Sound hood 18 is freely rotationally supported by means of the hinge portion 24 on shaft 58. Shaft 58 serves as a hinge pin.

Shaft 58 extends through bushing 60, freely through the interior cylindrical surface 62 on friction member 54 and through hole 64 in pivot arm 26. Bolt 66 is threadedly engaged with the interior threads in the end of shaft 58 to retain the pivot arm 26, friction member 54, and bushing 60, on the exterior of shaft 58 with the bushing 60 in generally abutting relationship with the projection 68 on sound hood 18.

Referring to friction member 54 in FIG. 3, the formation of member 54 includes a lug 70 extending outwardly in a generally radial fashion from the axis of member 54. Additionally, extending generally axially from the cylindrical portion of friction member 54 are a plurality of ribs 72 formed radially around the axis of rotation of member 54 and extending parallel to the axis of rotation thereof. These ribs 72 are dimensioned such that the fit between the interior surface of bushing 60 and the ribs 72 is one of a frictional interference engagement causing friction member 54 to assume a fixed rotational and axial position with respect to bushing 60 unless physically and forceably caused to rotate or axially shift. Between ribs 72 are relieved portions 74 for permitting somewhat easier assembly.

The pivot arm 26 is provided with a semi-cylindrical lug 80 extending inwardly of the print zone opening 12 of the typewriter 10 from the arm 26. This lug 80 is engageable by the hook 40 of bellcrank 38. In order to be engaged by the hook 40, the pivot arm 26 must be pulled forward toward the operator about pin 28 so that it occupies a position as illustrated in FIG. 7. If the arm 26 is placed in a position as illustrated in FIG. 7 and then the top cover 32 of the typewriter 10 is opened, since bracket 30 which carries both pin 28 and pin 34 is attached to the top cover 32, bracket 44 is disengaged from tab 42 and tab 42 may respond to the removal of the force of bracket 44 by moving counterclockwise about pins 34, 36. As this occurs, hook 40 will pivot counterclockwise about pins 34 and 36 and engage lug 80, thereby holding pivot arm 26 in the position shown in FIG. 7 with respect to top cover 32. Since top cover 32 is being raised, the pivot arm 26 and the sound hood 18 and visor 20 will be prevented from falling.

Figure 4:
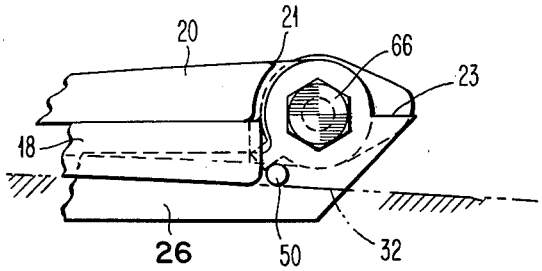
FIG. 4 illustrates a partial right end view of the sound hood assembly in a totally closed position.
Figure 5:
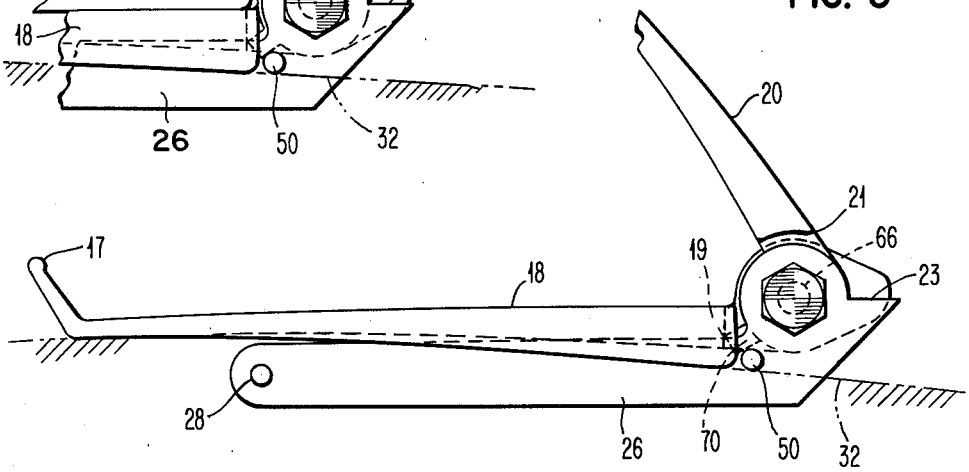
FIG. 5 illustrates a right end view of the sound hood with a broken away visor shown in its erected position.
Figure 6:
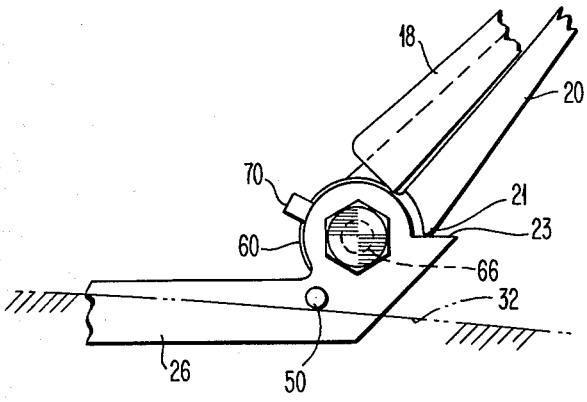
FIG. 6 illustrates the sound hood in a position where the sound hood and visor have been rotated about their axis to the rear to open the print zone opening of the typewriter.

The visor 20 may be positioned by the operator to occupy any one of a plurality of different positions. FIG. 4 illustrates the sound hood 18 and visor 20 in a partial end view where the visor 20 is depressed against sound hood 18. The visor 20 in FIG. 5 is shown in a partially erect position such as would be a normal operating condition blocking lighting glare from rear lighted areas. FIG. 6 illustrates the sound hood 18 raised to permit access to the printing zone of the typewriter 10 and illustrates the visor 20 having been rotated about its axis back to a position wherein the edge 21 of the visor 20 engages lip 23 on pivot arm 26. In all three views, stud 50 is illustrated as restraining the fall of pivot arm 26 below the top cover 32 by engagement with top cover 32. FIG. 7 illustrates the positioning of the respective members of the sound hood assembly with the sound hood 18 pulled forward toward the operator, thus relocating the pivot arms 26 into a forward position and allowing the collapse of the visor 20 with respect to the sound hood 18.

Referring to FIG. 1, the visor 20 is illustrated in a position approximating that which most operators would desire during the operation of the typewriter 10. Visor 20 may be positioned about its axis of rotation and shaft 58 by grasping the visor 20 and rotating it manually. As rotation of the visor 20 occurs, with all other portions of the sound hood assembly and sound hood 18 being in the position illustrated in FIG. 1, the interior surface of bushing 60 in frictional engagement with ribs 72 of friction member 54, must slide past ribs 72 in a direction substantially circumferential to member 54.

The ribs 72 slip on the inner surface of the bushing 60 but when the moving force on visor 20 is diminished or removed, the frictional engagement between ribs 72 and the inner portion of bushing 60 are sufficient to hold bushing 60 and, hence, visor 20 in whatever position is dictated by the relative positions of bushing 60 and frictional member 54 and ribs 72.

Frictional member 54 is constrained from rotational motion about its axis and rod 58 by lug 70 extending radially outwardly therefrom. Lug 70 is engageable with stud 52 or, alternatively, the inside lower edge 19 of sound hood 18. With sound hood 18 in its normal closing position, the edge 19, as best seen in FIG. 5, will be proximate to, if not in engagement with lug 70. Lug 70 due to the weight of visor 20 acting about the axis of rotation thereof and transmitting a torque by way of the frictional engagement of bushing 60 and frictional member 54, will be urged into engagement with stud 52.

Upon the engagement of lug 70 with stud 52, frictional member 54 is no longer able to rotate in a counterclockwise direction as shown in FIG. 3 and, therefore, will resist further counterclockwise rotation about its axis of rotation of glare visor 20. This will act to hold glare visor 20 in its desired prepositioned relationship with sound hood 18.

As the operator desired to create access to the print zone of the typewriter 10, the operator may grasp the leading lip 17 of the sound hood 18 and pull toward himself. As the operator does this, the pivot arms 26 will pivot about pin 28 raising the rear portion of the sound hood 18 and visor 20 and allowing the entire assembly to move forward toward the operator. As the pivot arms 26 permit the movement of the sound hood assembly to a position as illustrated in FIG. 7, it will be seen that stud 52 will rotate in a counterclockwise direction relative to the axis of shaft 58. The relative counterclockwise rotation of stud 52 about the axis of shaft 58 will act to relieve the force exerted by stud 52 against lug 70 of frictional member 54 and, therefore, allow frictional member 54 to likewise rotate in a counterclockwise direction to the extent necessary to lower the glare visor 20 onto sound hood 18. Once the visor 20 has completely collapsed onto sound hood 18, further forward movement will have no effect on visor 20. Upon the reversal of the above described movement, the operator acting to position the sound hood 18 in its closed position, the stud 52 will then rotate around shaft 58 in a clockwise direction and at some point in that movement will engage lug 70. Further pivoting of pivot arm 26 in a clockwise direction about shaft 58 will act to then rotate frictional member 54 in a clockwise direction and the frictional force exerted by ribs 72 on bushing 60 will cause the raising of visor 20 to the position previously selected by the operator and defined by the the relative angular displacement between the visor 20 and lug 70. As can be seen from the above description, visor 20 will return to whatever position is dictated by the relative positions of visor 20 and frictional member 54 when lug 70 of frictional member 54 is engaged with stud 52.

In the event that the operator desired to position the sound hood 18 in a position represented in FIG. 6, when sound hood 18 engages the underside of visor 20, visor 20 is free to rotate until such time as edge 21 contacts surface 23 of pivot arm 26 stopping further clockwise rotation. The sound hood 18 may be repositioned manually by rotating it in a counterclockwise direction as viewed in FIG. 6 until edge 19 of sound hood 18 engages lug 70. At that point, sound hood 18 will force lug 70 downward as hood 18 continues its counterclockwise movement to its closed position. As lug 70 is forced downward, visor 20 will be rotated in a counterclockwise direction by the frictional force transmission between frictional member 54 and bushing 60. This movement will continue until the weight of visor 20 acts to force lug 70 against stud 52 or maintains lug 70 against the edge 19 of sound hood 18.

Although the figures show and the description is specific to the parts found on the right end of the sound hood assembly, the left end is a mirror image with the exceptions that the mounting bracket 30, and associated spring 48, bellcrank 38, bracket 44 and pins 36, 34 are not present and pin 28 would be mounted on the top cover 32. Lug 80 is not found on the left pivot arm 26.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A sound hood for suppressing noise emanating from a typewriter of the type having an opening in the top thereof for access to the printing region of said typewriter, comprising:

a first elongate panel member with a surface substantially coextensive with said opening;

a second elongate panel member with an elongated dimension substantially coextensive with said first panel member positioned with one elongated edge of each of said panel members proximate each other;

means for mounting said first and second panel members with said first panel member proximate said opening;

pivot and friction means engageable with said first and second panel members proximate one another at said elongated edges and for pivotally mounting said panel members with respect to each other and for frictionally resisting relative movement between said panel members;

means operatively engageable with said pivot and friction means, responsive to movement of said first panel member to a position proximate said opening for raising said second panel member with respect to said first panel member to a position previously determined by said pivot and friction means, whereby said second panel member is raised to and maintained in a raised position with respect to said first panel member upon the closure of said first panel member over said opening.

2. The sound hood of claim 1 wherein said means for mounting further comprises a pair of members pivotally attached to said typewriter and said panel members.

3. The sound hood of claim 1 wherein said second panel member is opaque.

4. The sound hood of claim 1 wherein said pivot and friction means comprises at least a pair of mating members having a frictional engagement therebetween of such a magnitude as to prevent the movement of said second panel member by gravitation forces.

5. The sound hood of claim 1 wherein said pair of mating members are frictionally engaged in regions defining portions of a cylinder.

6. The sound hood of claim 5 wherein said pivot and friction means has a pivot axis.

7. The sound hood of claim 6 wherein said cylinder is coaxial with said pivot axis.

8. A sound hood for a typewriter, said typewriter defining an elongate aperture and a top thereof having a first and second long edges and a width thereto;

a first pivot means defining a first pivot axis proximate said first edge and parallel to and substantially adjacent said first edge;

plural arms, one end of said plural arms associated with said first pivot axis and extending a portion of the width of said aperture;

second pivot means associated with said aperture defining portion of the typewriter to further define a second pivot axis;

said arms associated with said second pivot means and said second pivot axis and pivotally rotatable from a position proximate said first edge to a position removed from said first edge of said aperture;

a first and second panel means;

said first panel means substantially coextensive with said elongate aperture and pivotable on and about said first pivot means and said first pivot axis, respectively;

said second panel means pivotable on and about said first pivot means and said first pivot axis, respectively, and with respect to said first panel means;

erecting means frictionally engaged with said second panel means for holding said second panel means in an erected preselected position with respect to said first panel means;

said erecting means operatively associated with at least one of said plural arms and responsive to movement of at least one of said arms proximate said first edge to a position removed from said first edge to render said erecting means ineffective whereby said second panel means may freely move to a position proximate said first panel means;

said erecting means further responsive to movement of at least one of said arms from said position removed from said first edge to a position proximate said first edge to rotate said second panel means with respect to said first panel means to re-erect said second panel means to said predetermined position.

9. The sound hood of claim 8 wherein said second panel means comprise cylindrical support means therefor.

10. The sound hood of claim 9 wherein said erecting means comprises a sleeve coaxially positioned with respect to said first pivot means and coaxially inserted within said cylindrical support means.

11. The sound hood of claim 10 wherein the relationship of said sleeve and said cylindrical support means is one of an interfering frictional fit.

12. The sound hood of claim 11 wherein said sleeve comprises ribs formed into its exterior surface for engagement with said cylindrical support means.

13. The sound hood of claim 10 wherein said sleeve further comprises a lug member extending outwardly therefrom for movement limiting engagement with said arms, for holding said sleeve in a predetermined spacial position.

14. The sound hood of claim 8 wherein said first panel means is transparent and said second panel means is opaque.

15. A sound hood for a typewriter of the type having a printing region and an aperture for access to said printing region comprising:

a first panel member for closing said aperture in said typewriter;

a pair of arms;

first pivot means, having an axis, for pivotally mounting said arms to said first panel member;

a second pivot means for pivotally mounting said arms to said typewriter to permit movement of said first panel member to a position displaced from said aperture and movement to a second position proximate said aperture;

a second panel member pivotally mounted coaxially with and by said first pivot means for movement about said first pivot means;

panel coupling means including at least one friction member engaging said second panel member for providing resistance to said movement of said second panel member about said first pivot means and with respect to said friction member;

said panel coupling means also including movement limiting means engageable with said first panel member to hold said friction member when said second panel member is moved with respect to said first panel member by overcoming said resistance;

said movement limiting means engageable by at least one of said arms for pivoting said movement limiting means and said second panel member about said axis of said first pivot means, thereby moving said second panel member with respect to said first panel member to erect said second panel member with respect to said first panel member upon placement of said first panel member in said second position.

16. The sound hood of claim 15 wherein said second panel member comprises cylindrical support means therefor.

17. The sound hood of claim 16 wherein said panel coupling means comprises a sleeve coaxially positioned with respect to said first pivot means and coaxially inserted within said cylindrical support means.

18. The sound hood of claim 17 wherein the relationship of said sleeve and said cylindrical support means is one of an interfering frictional fit.

19. The sound hood of claim 18 wherein said sleeve comprises ribs formed into its exterior surface for engagement with said cylindrical support means.

20. The sound hood of claim 19 wherein said sleeve movement limiting means comprises a lug member extending outwardly from said sleeve for movement limiting engagement with said arms, for holding said sleeve in a predetermined spacial position.

21. The sound hood of claim 15 wherein said first panel member is transparent and said second panel member is opaque.

* * * * *